US005484104A

United States Patent [19]

Kukler

[11] Patent Number: 5,484,104

[45] Date of Patent: Jan. 16, 1996

[54] FUEL INJECTOR PRESSURIZED BY ENGINE CYLINDER COMPRESSION

[75] Inventor: Ronald Kukler, Highton, Australia

[73] Assignee: Interlocking Buildings Pty Ltd., Victoria, Australia

[21] Appl. No.: 199,186

[22] PCT Filed: Aug. 26, 1992

[86] PCT No.: PCT/AU92/00453

§ 371 Date: Feb. 25, 1994

§ 102(e) Date: Feb. 25, 1994

[87] PCT Pub. No.: WO93/04275

PCT Pub. Date: Mar. 4, 1993

[30] Foreign Application Priority Data

Aug. 26, 1991 [AU] Australia ..... PK7984

[51] Int. Cl.[6] ..... F02M 49/02; F02M 47/00

[52] U.S. Cl. ..... 239/87; 239/585.1; 123/496

[58] Field of Search ..... 123/345, 435, 123/467, 504, 506, 496; 239/87, 88, 585.1, 585.5, 91, 533.8

[56] References Cited

U.S. PATENT DOCUMENTS

| | | | |
|---|---|---|---|
| 2,230,920 | 2/1941 | Wirsten | 123/435 |
| 2,333,944 | 11/1943 | Lieberherr | 123/435 |
| 2,389,492 | 2/1944 | Edwards | 123/139 |
| 2,516,690 | 7/1950 | French | 239/87 |
| 4,129,256 | 12/1978 | Bader, Jr. et al. | 239/96 |
| 4,247,044 | 1/1981 | Smith | 239/87 |
| 4,394,856 | 7/1983 | Smith et al. | 123/506 |
| 4,427,151 | 1/1984 | Trenne | 239/87 |
| 4,948,044 | 8/1990 | Brisbon et al. | 239/91 |

FOREIGN PATENT DOCUMENTS 2076073 11/1981 United Kingdom .

*Primary Examiner*—Kevin P. Weldon

*Attorney, Agent, or Firm*—Ware, Fressola, Van Der Sluys & Adolphson

[57] ABSTRACT

A fuel injector is actuated by cylinder compression pressure acting against the exposed face (31) of piston means (30, 35) to compress fuel in high pressure chamber (45) in injector body (10). The piston means (30, 35) moves against spring (36) and controllable fuel pressure in low pressure chamber (37). The high pressure chamber (45) communicates with injection orifice (68) via delivery chamber (65) and non-return delivery valve (56). Fuel delivery is regulated by varying fuel pressure in low pressure chamber (37) and various means are disclosed for controlling this pressure.

14 Claims, 3 Drawing Sheets

FUEL INJECTOR PRESSURIZED BY ENGINE CYLINDER COMPRESSION

BACKGROUND OF THE INVENTION

This invention relates to injecting apparatus for injecting a fluid under pressure, e.g. fuel injecting apparatus for internal combustion engines, apparatus for injecting liquids, e.g. a catalyst into chemical reaction vessels under pressure, and other apparatus for injecting a dose of fluid.

Although the present invention is applicable to any situation where a measured dose of fluid is to be injected under pressure, it will be convenient to describe the invention with particular reference to injecting fuel into an internal combustion engine.

Fuel injectors used in internal combustion engines, including both spark ignition and compression ignition (or diesel) engines generally utilise an external pump for supplying the fuel under sufficient pressure to be injected into the engine cylinder. The timing of the injection point in the engine operating cycle is determined by externally controlling the operation of an injector valve by mechanical means. One disadvantage of providing external pumping and control is the need for the provision and servicing of such external systems.

A general problem with injectors, particularly ones supplied from an external pump, is lack of responsiveness to any faulty condition in the associated cylinder. For example, if a piston ring is broken, known injectors will continue to inject fuel charges into the cylinder. Thus fuel will be exhausted from the engine leading to air pollution by exhausted unburnt fuel.

It has been proposed in the past to utilise the build up of pressure within the cylinder of an internal combustion engine during the compression stroke to provide the motive force to compress fuel within the injector body. For example, there has been proposed a fuel injector which has a body, and a piston which is movable within the body under the action of cylinder pressure. The movement of the piston in the injector body causes an increase in pressure of a fuel charge introduced into the body to a point where the pressure enables a non-return valve associated with the injector nozzle to open and allow the fuel to be injected under pressure into the engine cylinder. Problems with this device include difficulty and uncertainty in closing of the valve leading to fuel continuing to dribble from the injector after the desired cut off point, and also a general lack of control over the operation of the injector.

U.S. Pat. No. 2,516,690 in the name of French shows a fuel injector which utilises the associated engine cylinder pressure to develop the pressure to inject the fuel. The French apparatus has a simple spring biased non-return valve at the injection nozzle so that the opening and closing of the injection nozzle is solely controlled by pressure differential and spring force. Some control of pressure developed is provided by a non-return valve in an outlet from the pumping chamber and an adjustable flow restrictor downstream of the non-return valve. The French apparatus has very limited ability to enable control of the injector operation including timing, injection pressure, volume of fluid injected, and degree of positiveness in action.

U.S. Pat. No. 4,394,856 in the name of Smith also shows an injector using engine cylinder pressure to develop the injecting pressure. The Smith apparatus uses a non-return valve as the injection valve. A solenoid operated non-return valve is provided in the outlet from the pumping chamber and an adjustable flow restrictor is provided in the outlet line downstream of the non-return valve to enable adjustment of the possible rate of flow when the solenoid non-return valve is opened. In a similar manner to the French US patent, the Smith injector has very limited ability to enable control of the injector operation including timing, injection pressure, volume of fluid injected, and degree of positiveness in action.

U.S. Pat. No. 4,427,151 in the name of Trenne shows a similar injector to the Smith injector except that there is provision for adjusting the clearance between the outlet valve member controlled by the solenoid and its associated seat so that that adjustment enables some control of the flow rate for fuel flowing out of the control chamber. As with the French and Smith specifications, the Trenne injector has limited degrees of control and limited positiveness in operation, particularly the non-return injector valve.

SUMMARY OF THE INVENTION

According to the present invention there is provided an injecting apparatus for injecting a fluid under pressure, the injecting apparatus including: a body, piston means movable in the body under the action of externally applied fluid pressure, the piston means being operable to compress in a high pressure chamber, fluid to be injected the piston means being movable against the action of fluid pressure in a low pressure chamber whereby the movement of the piston means is selectively controllable by controlling the fluid pressure in the low pressure chamber, and an injection valve and an associated injection orifice in fluid communication with the high pressure chamber whereby high pressure fluid from the high pressure chamber can be injected through the injection orifice upon opening of the injection valve.

Preferably the injection valve which controls injection of high pressure fluid through the orifice is selectively controllable in its operation. The injection valve may include a valve member movable against the action of fluid pressure in a control chamber, the fluid pressure in the control chamber being selectively controllable to control operation of the injection valve. The control chamber is preferably in fluid communication with the low pressure chamber whereby an increase in fluid pressure in the low pressure chamber to resist movement of the piston means also increases the fluid pressure in the control chamber resisting opening of the injection valve.

In the preferred embodiment the high pressure chamber communicates with the injection orifice through a delivery chamber, the high pressure fluid from the high pressure chamber being supplied to the delivery chamber through a non-return delivery valve, the non-return delivery valve being operable to close the delivery chamber and maintain in the delivery chamber a charge of fluid stored under pressure. Preferably the non-return delivery valve has a valve member having a first stage of movement in which it moves to stop communication from the pressure chamber to the delivery chamber and a second stage of movement in which the valve member after having completed its first stage of movement allows limited pressure relief in the delivery chamber so as to thereby reduce the fluid pressure upstream of the injection valve.

The piston means is preferably movable under the action of the externally applied fluid pressure against the action of a main spring, the force applied by the main spring at least in part determining the externally applied fluid pressure necessary to initiate movement of the piston means, the injecting apparatus further including a delivery spring against the action of which the injection valve moves to allow fluid injection through the orifice, the strength of the delivery spring determining at least in part the pressure of fluid in the high pressure chamber necessary to open the injection valve to allow fluid injection through injection orifice.

Preferably there is provided a bleed path for high pressure fluid to bleed from the high pressure chamber upon movement of the piston means by a predetermined maximum extent, the opening of the bleed path as a result of said predetermined maximum movement occurring relieving fluid pressure in the high pressure chamber to an extent sufficient to stop injection of fluid through the injection valve.

The present invention also provides an injecting system comprising an injecting apparatus according to the invention, a fluid pressure relief path through which fluid pressure in the low pressure chamber can be controllably relieved to permit and control movement of the piston means, and an associated fluid pressure governor means, the governor means being selectively controllable to control the fluid pressure in the low pressure chamber by selectively preventing or progressively limiting relief of pressure from the low pressure chamber through the fluid pressure relief path in response to movement of the piston means. In this injecting system, the governor means may include a flow restriction means in the fluid pressure relief path to selectively control the cross sectional area of the fluid pressure relief path, the flow restriction means having an associated drive means so as to drive the flow restriction means to vary the cross sectional area of the relief path, the governor means further including a back pressure valve located in the fluid pressure relief path, downstream of the flow restriction means, the back pressure valve being operative to maintain a predetermined minimum back pressure in the fluid pressure relief path by only opening when the predetermined minimum back pressure is exceeded.

The fluid pressure relief path preferably includes a pressure compensating means which includes a restriction and varying means for varying the size of the restriction in response to changes in fluid pressure downstream thereof, the varying means being operative to reduce the area of the restriction to maintain a predetermined pressure downstream of the pressure compensating means. The pressure compensating means may comprise a chamber which communicates with the low pressure chamber, the pressure compensating means further including a shuttle valve responsive to the pressure differential between the fluid pressure in that chamber and a point further downstream in the fluid pressure relief path and being operative in response to an increase in the pressure differential to reduce the area of the restriction and thereby retard pressure relief from the chamber to the point further downstream.

The injecting system may further include a controllable damper means in communication with the fluid pressure relief path, the damper means including a movable damper member responsive to a pressure increase in the fluid pressure relief path to yield so as to thereby relieve pressure in the fluid pressure relief path, the damper means further including an adjustable limiting means associated with the movable damper member to controllably limit the extent of yielding movement, the limiting means thereby effectively determining the pressure relief provided by the damper means. The movable damper member may comprise a resilient damper disc which defines one wall of a chamber which is in communication with the fluid pressure relief path, the limiting means comprising a limiting stop which is adjustable so as to be contacted by the damper disc.

The injecting system in another embodiment may be characterised in that the fluid pressure relief path includes a high speed solenoid valve operative to open and close the fluid pressure relief path in response to actuation signals, the governor means being located downstream of the solenoid valve and being operative to adjustably limit in continuous increments the flow of fluid through the fluid pressure relief path.

Possible and preferred features of the present invention will now be described with particular reference to the accompanying drawings. However it is to be understood that the features illustrated in and described with reference to the drawings are not to be construed as limiting on the scope of the invention. In the drawings:

DESCRIPTION OF THE PREFERRED EMBODIMENT

Figure 1:
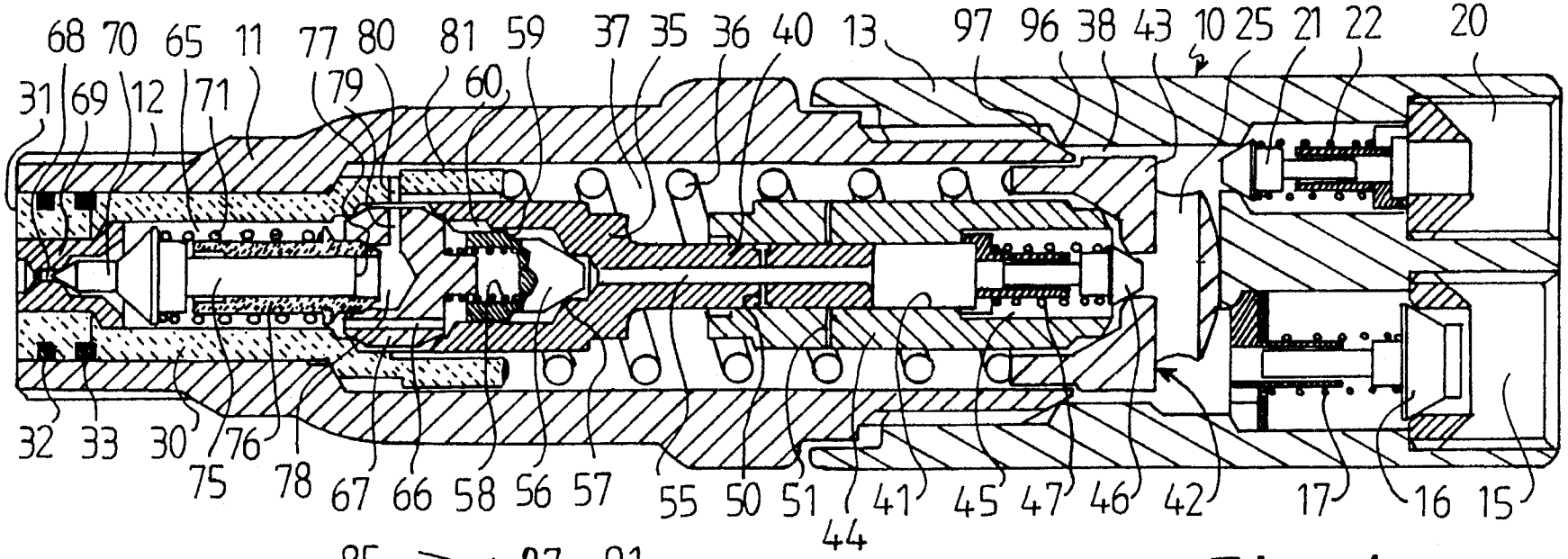
FIG. 1 shows a cross sectional view through an injector according to the present invention.

Referring to FIG. 1, the injector includes a body 10 which comprises a front body part 11 which can for example have a threaded end 12 for engagement in a threaded port associated with an engine, and a rear body part 13. An inlet 15 is provided in the body 10, the inlet 15 having a non-return valve 16 operated by spring 17. In use, fuel is supplied or induced under low pressure into the inlet 15 sufficient to overcome the action of spring 17. The strength of spring 17 is not critical. The fuel pressure can be relatively low so that high pressure fuel lines are not required.

An outlet 20 has an associated non-return valve 21 acting by means of spring 22, the strength of which is not critical. With this arrangement, fuel can continuously be pumped or induced under low pressure into inlet 15, through passage 25 and out through outlet 20. This continuous fuel flow can provide cooling although supplementary cooling could be provided.

The injector includes a low pressure piston 30 slidable in the front body 11 when engine cylinder pressure acts on the front face 31. Compression ring 32 and oil scraper ring 33 are provided for conventional purposes.. Screwed to the low pressure piston 30 is a high pressure piston 35. The piston assembly 30, 35 moves within the body 10 against the action of main spring 36. The force applied by main spring 36 determines, in part, whether the piston assembly 30, 35 will move under the action of cylinder pressure on face 31. Also, the main spring 36 is located in a low pressure chamber 37 which is in fluid communication through space 38 with the passage 25 and through valve 21 with the outlet 20 so that the fluid pressure in low pressure chamber 37 resisting movement of the piston assembly 30, 35 can be relatively low, subject to control to be described later.

A possible variation of the preferred construction illustrated and described is the replacement of the main spring 36 with a pneumatic or other biasing means.

The high pressure piston 35 has an extension 40 of relatively small cross sectional area which travels within a bore 41 provided within a high pressure body 42. The high pressure body 42 comprises a base section 43 and a high pressure barrel 44 in which the extension 40 travels. The base section 43 and high pressure barrel 44 are secured together and define a high pressure chamber 45 in which fuel is compressed to high pressure by the extension 40 of the high pressure piston 35. Non-return valve 46 operated by a spring 47 allows fuel to enter the high pressure chamber 45 from the passage 25 upon retraction of the high pressure piston extension 40 in the bore 41. The strength of spring 47 is not critical.

In the extension 40 there is provided a bleed bore 50 and extending through the high pressure barrel 44 is a bleed bore 51 which opens into the low pressure chamber 37. If the stroke of the piston assembly 30, 35 is sufficient for the bleed bore 50 to align with the bleed bore 51, the fuel within the high pressure chamber 45 is immediately placed in communication with the low pressure chamber 37 and the fuel pressure in high pressure chamber 45 will immediately drop so that there will be insufficient pressure for fuel injection to continue as will be described later. Thus the longitudinal separation between the bleed bore 50 and the bleed bore 51 effectively defines the maximum fuel charge that can be injected during one stroke of the piston assembly 30, 35 and this, in turn, effectively limits the speed of running of the associated engine to a predetermined maximum determined by the maximum fuel charge.

Running longitudinally through the extension 40 of the high pressure piston 35 is a fuel passage 55 along which pressurised fuel from the high pressure chamber 45 travels as the piston assembly 30, 35 moves under the action of the cylinder pressure. The fuel passes a non-return delivery valve 56 which is shown resting against shoulder 57 under the action of spring 58. In operation, high pressure fuel moves valve 56 away from shoulder 57 against the action of spring 58. Fuel flows past the valve 56 only when it has moved sufficiently for the shoulder 59 of the valve to move past the end of passage 60 formed on the inside surface of the high pressure piston 35. With this arrangement, when delivery valve 56 is closing, fuel flow past the valve 56 is stopped when the shoulder 59 reaches the end of the passage 60, after which the valve 56 continues to move by a further limited extent until the valve 56 reaches shoulder 57. This continued movement of valve 56 after the valve has closed off fuel flow relieves pressure on the downstream side of the valve 56 for a purpose which will be described later.

The low pressure piston 30 has a delivery chamber 65 into which high pressure fuel is introduced through bore 66 provided in the spacer 67. At forward end of the delivery chamber 65 is a delivery orifice 68 provided in an insert 69. The orifice 68 is shown closed by needle type delivery valve 70 which seats against the insert 69 under the action of delivery spring 71. When the pressure of fuel in the delivery chamber 65 is sufficiently great, the needle valve 70 moves against the action of delivery spring 71 and opens the orifice 68 and fuel is injected through the orifice 68 into the associated engine cylinder. The commencement of injection through orifice 68 causes an immediate drop in fuel pressure in delivery chamber 65 and the needle valve 70 will tend to close the orifice 68 again. This, in turn, will allow pressure in delivery chamber 65 to rise and again open needle valve 70. This process continues so that the needle valve 70 opens and closes the orifice 68 at high speed. This action is known as "buzzing" of the delivery needle valve 70 and causes the fuel to be injected through orifice 68 in waves and this is believed to improve fuel combustion efficiency.

The needle valve 70 has a shank 75 which moves within a guide 76. The end 77 of the shank 75 remote from the delivery orifice 68 closes a control chamber 78. Control chamber 78 communicates through (aligned) bores 79, 80 provided in the spacer 67 and low pressure piston 30 respectively and through the space 81 around the outside of the low pressure piston 30 with the low pressure chamber 37. Thus the control chamber 78 is normally in communication with low pressure fuel allowing the needle valve 70 and shank 75 to move away from the insert 69 to open the orifice 68 under the pressure of fuel in the delivery chamber 65.

Figure 2:
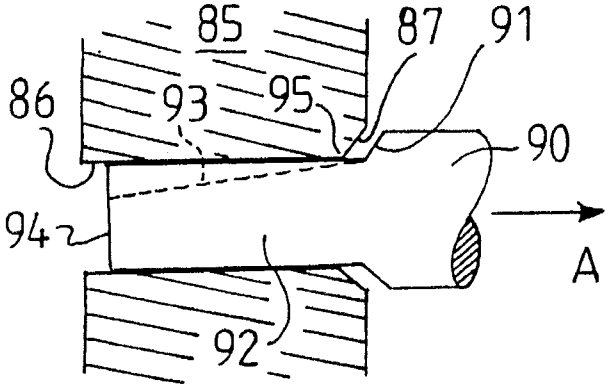
FIG. 2 shows a cross sectional view through one possible arrangement of a governor or accelerator for use in controlling operation of the injector.

Referring to FIG. 2, there is shown an accelerator or governor means which enables control of the flow of fuel on the downstream side of the injector. In particular, in use, the governor means shown in FIG. 2 comprises a body 85 having a bore 86 which is in communication with the outlet 20 of the injector. The downstream end of the bore 86 is provided with a chamfered seat 87. Longitudinally selectively movable within the bore 86 is a governor 90 which has a complementary chamfered shoulder 91 which can close against seat 87 to completely close bore 86. The governor 90 has a shank 92 which extends into the bore 86 and is a close fit within the bore. The shank 92 has a groove 93 which tapers from the shoulder 91 to the upstream end 94 of the shank 92. The fuel can flow into the bore 86 along the groove 93 and between the shoulder 91 and seat 87 when the governor 90 is retracted longitudinally in the direction of arrow A. If the governor 90 is retracted only slightly from the seat 87, flow along the groove 93 is significantly restricted since the fuel must flow through the shallowest end of the groove 93 where the seat 87 meets the bore 86 at point 95. If the governor 90 is retracted further in the direction of arrow A, greater flow past point 95 is possible because of the deepening of the groove 93 towards the end 94. Thus the selective retraction and insertion of the governor 90 from and into the bore 86 enables control of the pressure in low pressure chamber 37 of the injector, which in turn, can control the stroke of the piston assembly 30, 35. If the governor 90 is moved to contact the shoulder 91 against the seat 87, the fuel flow through outlet 20 of the injector is prevented and this will hydraulically lock the piston assembly 30, 35 against movement by blocking the pressure relief path for fuel from low pressure chamber 37.

The movement of the governor 90 in FIG. 2 can be achieved by any suitable means such as a mechanical adjustment of the position of governor 90. Alternatively the governor 90 could be moved by a DC electric motor or linear motor enabling electronic control of the fuel injection. In this way, it is possible to infinitely vary the fuel injection by controlling governor 90 in a continuous manner, thereby controlling continuously the low pressure side of the injector which in turn enables control of the point in an operating cycle at which movement of the piston assembly 30, 35 is allowed to commence. In general terms, the hydraulic control of the low pressure side of the piston assembly 30, 35 of the injector enables precise control of the point of commencement of the stroke of the piston assembly 30, 35 which controls the amount of fuel injected, up to a maximum charge determined by the spacing of the bleed bore 50 and 51.

In operation of the injector in an internal combustion engine, the increasing pressure on the front face 31 of the low pressure piston 30 during the compression state of the engine will tend to move the piston assembly 30, 35 against the action of both the main spring 36 and the fluid pressure in chamber 37. If the pressure relief from the low pressure chamber 37 through outlet 20 is permitted, the piston assembly 30, 35 retracts to compress fuel in high pressure chamber 45. The fuel flows through fuel passage 55, past delivery valve 56 and into delivery chamber 65. The pressure in chamber 65 causes the needle valve 70 to open against the action of both delivery spring 71 and the pressure in low pressure chamber 37 which, in turn, is in communication with control chamber 78 so that fuel injection through orifice 68 commences.

Initially, fuel will be injected in relatively large droplets since the pressure in the engine cylinder is still relatively low. However, in the case of a compression ignition engine, immediately ignition of the fuel in the cylinder occurs, there is a rapid increase in cylinder pressure which acts on face 31 of the piston 30. This pressure jump immediately causes a multiplication of the fuel injection pressure so that the fuel being injected through orifice 68 at a greatly increased pressure will emerge in much smaller droplets which improves the combustion efficiency. The initial injection pressure jump may be from 4000 psi to 25000 psi. The ratio of injection pressure to input pressure may be between 6:1 and 12:1.

It is possible to control the proportion of the total fuel charge which is injected at the initial relatively low pressure by adjustment of the strengths of the main spring 36 and the delivery spring 71. For example, increasing the strength of the main spring 36 retards the point of movement of the piston assembly 30, 35 thus delaying the commencement of injection and reducing the proportion of the fuel which is injected during the initial low pressure injection stage prior to ignition. By adjustment of these spring forces, it is possible to affect the efficiency of combustion and hence control emissions, e.g. for different cylinder sizes. The ratio of the high and low pressures of injection is also controllable.

The maximum fuel charge is determined by the spacing of the bleed bores 50, 51 which effectively also provides a maximum engine speed limiter. In particular, when the bleed bores 50 and 51 align, the fuel pressure in the high pressure chamber 45 is immediately relieved through the bleed bores 50, 51 and this pressure drop is immediately conveyed to the delivery chamber 65 so that the needle valve 70 immediately closes.

The external control of the pressure relief through the outlet 20 of the injector, e.g. by means of the governor means shown in FIG. 2, not only controls the point of opening movement of the piston assembly 30, 35 but also controls the low pressure side in chamber 37 during an injection operation. If the pressure relief through outlet 20 is retarded, the movement of piston assembly 30, 35 is limited by the relief of pressure in the low pressure chamber 37 and also the opening movement of the needle valve 70 is resisted by the retarded relief of pressure in control chamber 78 acting against face 77 of the shank 75 of the needle valve 70. Thus low pressure side hydraulic lock up controls termination of the fuel injection operation. Alternatively, the termination of the injection operation occurs when the maximum fuel charge is injected and the bleed bores 50, 51 align and cause an immediate high pressure side pressure drop. In either case, the delivery needle valve 70 closes the orifice 68. The delivery valve 56 also will immediately move towards its closed position under the action of spring 58 so that the shoulder 59 reaches the end of passage 60 thus closing off communication between the high pressure chamber 45 and the delivery chamber 65. Because the delivery valve 56 continues to move beyond the point at which shoulder 59 reaches the end of passage 60, the fluid pressure in delivery chamber 65 can continue to be relieved preventing opening of needle valve 70 until high pressure is again built up in delivery chamber 65. These combined actions of hydraulic lock up of the low pressure side or high pressure side pressure relief, together with the two stage movement of the delivery valve 56 ensure immediate and positive termination of the fuel injection.

Figure 3:
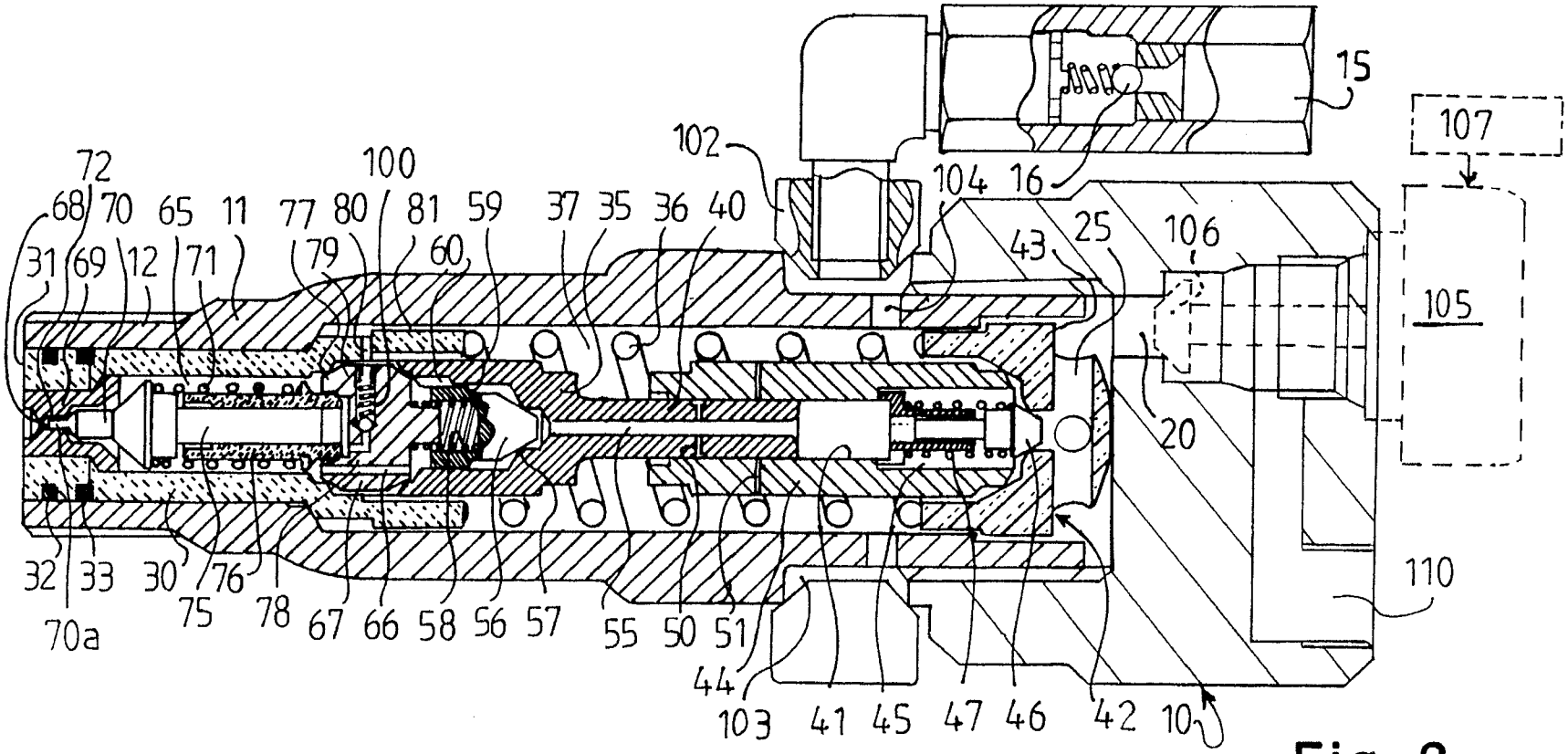
FIG. 3 is a cross sectional view through an alternative construction of injector according to the present invention.

The injector shown in FIG. 3 is in most respects the same as the injector shown in FIG. 1 and the same reference numerals are used for corresponding parts.

Different features in FIG. 3 include the modified needle valve 70 which, instead of a conical tip, includes a blunt nose portion **70*a* which substantially fills the "sack" 72 which is a small space immediately upstream of the orifice 68. The fuel remaining in the sack 72** in prior injectors was sometimes a cause of continued fuel introduction into the cylinder after the desired cut off point.

Also in FIG. 3, the spacer 67 is provided with a non-return valve 100 arranged to allow the flow from the control chamber 78 to the low pressure chamber 37 but preventing a shock loading at any time from being transmitted into the chamber 78.

In FIG. 3, the inlet 15 is shown in a different location with a relatively small inlet valve 16 allowing fuel under low pressure to pass from the inlet 15 to an inlet manifold 102 which encircles the body 10 and enables fluid to pass from the annular manifold space 103 through passages 104 to the low pressure chamber 37.

Also in FIG. 3, there is provided a high speed solenoid 105 having an associated valve member 106 arranged to selectively close the outlet 20. The solenoid 105 can be energised under the control of an electrical switching means 107 by means of which the time of commencement of injection is controllable and also the length of the period of injection is also controllable. In particular, the opening of the valve 106 by solenoid 105 under the control of the control means 107 enables the injection to commence. Prior to opening of the valve 106 the piston assembly 30, 35 is effectively hydraulically locked against movement. Similarly, closing of the valve 106 will again lock the piston assembly 30, 35 against movement thereby terminating the injection.

Downstream of the valve 106 there is an outlet port 110 through which pressure relieving flow can take place when the valve 106 is open. Associated with the outlet port 110 or downstream thereof there is preferably provided an adjustable flow restriction means to enable selective control of the rate of pressure relieving flow through the outlet port 110, the adjustable flow restriction comprising a governor arrangement such as shown in FIG. 2.

Figure 4:
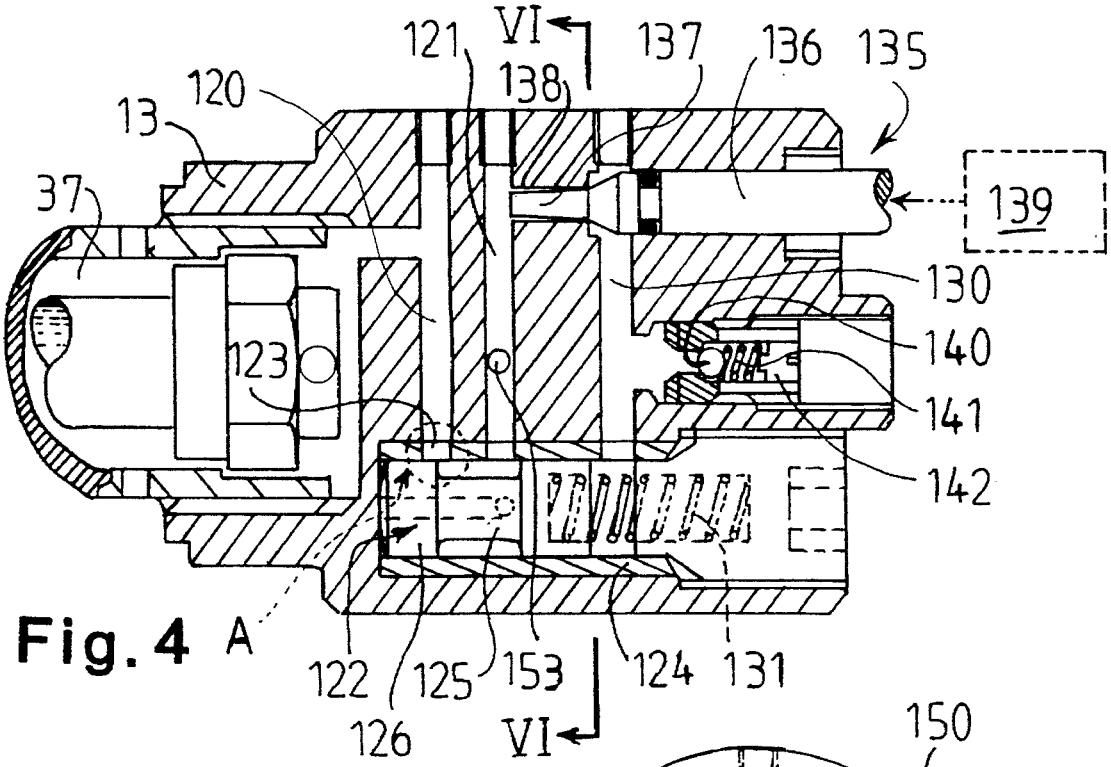
FIG. 4 is a cross sectional view through the rear portion of a further possible construction of injector showing various means for enabling control of the injector operation.

FIG. 4 showns an alternative injector control arrangement located at the rear body 13 of the injector, although the control arrangement may be a separate unit connected in the fluid pressure relief path from the low pressure chamber 37. In the embodiment in FIG. 4, pressure relief from the chamber 37 is provided through a fluid pressure relief path comprising a first chamber 120 which communicates with an intermediate chamber 121 through a pressure compensating means 122 comprising a restriction 123 (FIG. 5) shown in the form of a slot provided within sleeve 124. Inside the sleeve there is provided a shuttle valve member 125 having a head 126 which progressively closes or opens the slot 123 as the shuttle valve 125 moves within the sleeve 124.

The fluid pressure relief path also includes a downstream low pressure chamber 130. The fluid pressure in chamber 130, together with the force of spring 131 opposes movement of the shuttle valve 125 under the influence of fluid pressure from the chamber 120 passed to the intermediate chamber 121. However if the pressure differential between intermediate chamber 121 and low pressure chamber 130 rises sufficiently, the shuttle valve 125 will move and the head 126 will restrict the pressure relieving flow through the slot 123 thereby enabling the pressure in the intermediate chamber 121 to reduce by means of flow to low pressure chamber 130.

Interposed in the fluid pressure relief path between the intermediate chamber 121 and the low pressure chamber 130 is a selectively controllable flow restriction means 135 which comprises a needle valve 136 having a tapered nose portion 137 located in the passage 138 extending between intermediate chamber 121 and low pressure chamber 130. The needle valve 136 is selectively movable by means of electrical or mechanical control means 139 so as to enable selective control of the rate of pressure relief through the passage 138. This, in turn, enables control of the injection rate.

Downstream of the flow restriction means 135 there is a non-return valve 140 which functions to maintain a minimum back pressure determined by the force of spring 141 which is a function of the spring itself and the position of adjustable seat 142 for the spring 141. At low idle speeds of an associated engine, the valve 140 determines the minimum back pressure. At higher engine speeds, the valve 140 remains open substantially all of the time.

Figure 6:
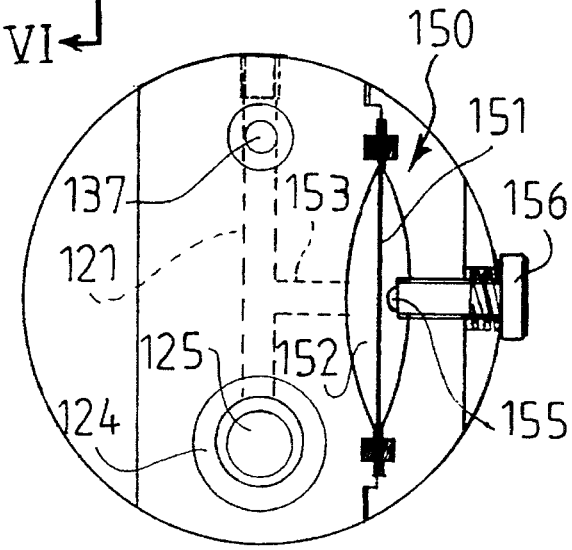
FIG. 6 is a sectional view along the line VI—VI in FIG. 4.

The system shown in FIG. 4 also provides a controllable damper means 150, illustrated more clearly in FIG. 6. The damper means 150 includes a movable damper member 151 illustrated as a damper disc mounted in a damper chamber 152 which is in communication through duct 153 with the intermediate chamber 121. The damper disc 151 yields resiliently upon an increasing pressure in the intermediate chamber 121. There is an adjustable stop member 155 which is adjustable by means of set screw 156 to enable selective setting of the limit of resilient movement of the damper disc 151. By adjusting the position of the stop member 155, the idle setting or speed of an associated engine can be effectively controlled. In particular, a relatively large gap between the stop member 155 and the damper disc 151 enables a larger stroke of the piston assembly 30, 35 before the other flow limiting means or pressure relief limiting means become effective, thereby enabling a higher idle speed to be set.

Figure 5:
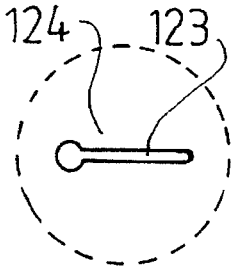
FIG. 5 is a plan view of the detailed section marked "A" in FIG. 4.

The embodiment of the injector system shown in FIGS. 4 to 6 and described above provides a great deal of control over the operation of the injector, including control over the timing of the start and end of injection, the rate of injection, idle speed, and even variation in rate of injection within a single injection cycle. The greater degree of control that is possible makes the injector system particularly suitable for direct fired internal combustion engines.

The construction and arrangement of the injectors and associated controllers illustrated and described with reference to the drawings enables accurate and repeatable control of the point of commencement of the injection, accurate and repeatable control of the charge of liquid which is injected during each injection cycle, and accurate and repeatable point of termination of the injection. The three stage positive termination of injection makes the injector suitable for high speed two stroke engines.

Automatic pollution control is one benefit of using the cylinder pressure to develop the injection pressure. In particular, if the engine cylinder develops a fault, such as a broken piston ring, leading to a drop in pressure in the cylinder, the pressure drop will immediately prevent or at least reduce the charge of fuel that the injector will introduce into that cylinder. Thus the engine will exhaust less unburnt fuel compared to an engine where a full charge continues to be injected into a faulty cylinder. This compensation also occurs in the case of normal wear of components so that pollution reduction and wear compensation results.

Another benefit of the injector is that it provides automatic timing adjustment. In particular, as an associated engine increases in running speed, ideally, the commencement of injection should be advanced in the operating cycle since the fuel needs a predetermined minimum time to burn completely regardless of the speed of the engine. With the injector of the present invention, as the engine piston commences the compression cycle, there is a faster build up of pressure in the cylinder at higher engine speeds since the heat is not escaping as quickly from the engine as at lower speeds. This more rapid increase in pressure will automatically advance the commencement of injection to earlier points in the engine cycle. This advancement can be in excess of 15° from initial setting to the point of injection at maximum engine speed.

A further advantage of the preferred injectors described and illustrated is the lowered average combustion overall pressure which results from the new combustion mode. This in turn can lead to the use of lighter components. The "new combustion mode" results from the different phases of the combustion of the fuel. If a pressure versus time graph for a conventional engine were shown, the graph rises sharply to a peak and drops rapidly. With the injectors of the preferred embodiment, the control of the injected droplet sizes and the injection pressures enables control of the combustion process so that the pressure time graph can have a relatively flat plateau so that the area under the graph which relates to the work can be the same as conventional engines but the lower maximum pressure leads to less stress in the motor and the ability to use smaller or lighter components.

Because the injectors described and illustrated requires low levels of lubrication due to the absence of bearing components, the injectors will function with a no wax diesel fuel making it possible to work in cold climates. With careful material selection, LPG can be directly used.

A further advantage of the preferred injector construction and operation is the ability to automatically prime the injector for a subsequent operation. By closing the external governor means, there is a hydraulic lock up of the low pressure side, and fuel will be stored in the delivery chamber 65 since the fuel cannot be released through the orifice 68 or through the delivery valve 56. Thus, when the associated engine is to be re-started, the first compression cycle of the associated engine will enable fuel under pressure in the delivery chamber 65 to be injected for commencing normal operation of the engine.

In the particular construction of injectors shown in the drawings, metal to metal contacts are used to provide sealing between immovable parts. For example, the front body 11 and rear body 13 are connected together with metal to metal contact between a sharp step 96 provided on the rear body 13 and a chamfered face 97 provided on the front body 11. This also applies to connections between the spacer 67 and the low pressure piston 30, between the spacer 67 and the high pressure piston 35, and between the high pressure barrel 44 and the base section 43. These connections are modified "Lenz ring seats" and provide good sealing under high pressures.

The valves, including the inlet valve 16, outlet valve 21, non-return valve 46, delivery valve 56 and the needle valve 70 preferably have sealing contact between the valve members and associated seats with an internal angle less than 90°, and preferably at about 60°. For example, the included angle in the point of the needle valve 70 is preferably about 60°. This relatively shallow angle of seating has been found to provide good sealing at a wide range of fluid pressures.

I claim:

1. An injecting apparatus for injecting a fluid under pressure, the injecting apparatus including:

a body (10), piston means (30, 35) movable in the body (10) under the action of externally applied fluid pressure, the piston means (30, 35) being operable to compress fluid to be injected in a high pressure chamber (45), the piston means (30, 35) being selectively movable against the action of fluid pressure in a low pressure chamber (37), the movement of the piston means (30, 35) being selectively controllable by controlling the fluid pressure in the low pressure chamber (37), a selectively controllable injection valve (70) and an associated injection orifice (68) in fluid communication with a delivery chamber (65) which in turn is in fluid communication with the high pressure chamber (45) whereby high pressure fluid from the high pressure chamber (45) can be injected through the injection orifice (68) upon opening of the injection valve (70), the injection valve (70) including a valve member (70, 75) movable under the action of fluid pressure in the delivery chamber (65) and against the action of fluid pressure in a control chamber (78), the fluid pressure differential between the delivery chamber (65) and the control chamber (78) being selectively controllable to control operation of the injection valve (70), the selective control of the operation of the injection valve and the selective control of the fluid pressure in the low pressure chamber (37) which controls the movement of the piston means (30, 35) together providing selective control of each of the timing, the pressure and the volume of fluid injected through the injection orifice (68).

2. An injecting apparatus as claimed in claim 1 characterized in that the control chamber (78) is in fluid communication with the low pressure chamber (37) whereby an increase in fluid pressure in the low pressure chamber (37) to resist movement of the piston means (30, 35) also increases the fluid pressure in the control chamber (78) resisting opening of the injection valve (70).

3. An injecting apparatus as claimed in claim 1 characterized in that the piston means (30, 35) is movable under the action of the externally applied fluid pressure against the action of a main spring (36), the force applied by the main spring (36) at least in part determining the externally applied fluid pressure necessary to initiate movement of the piston means (30, 35), the injecting apparatus further including a delivery spring (71) against the action of which the injection valve (70) moves to allow fluid injection through the orifice (68), the strength of the delivery spring (71) determining at least in part the pressure of fluid in the delivery chamber (65) necessary to open the injection valve (70) to allow fluid injection through the injection orifice (68).

4. An injecting apparatus injecting a fluid under pressure, the injecting apparatus including:

a body (10), piston means (30, 35) movable in the body (10) under the action of externally applied fluid pressure, the piston means (30, 35) being operable to compress fluid to be injected in a high pressure chamber (45), the piston means (30, 35) being selectively movable against the action of fluid pressure in a low pressure chamber (37), the movement of the piston means (30, 35) being selectively controllable by controlling the fluid pressure in the low pressure chamber (37), a selectively controllable injection valve (70) and an associated injection orifice (68) in fluid communication with the high pressure chamber (45) whereby high pressure fluid from the high pressure chamber (45) can be injected through the injection orifice (68) upon opening of the injection valve (70), the high pressure chamber (45) communicating with the injection orifice (68) through a delivery chamber (65), the high pressure fluid from the high pressure chamber (45) being supplied to the delivery chamber (65) through a non-return delivery valve (56), the non-return delivery valve (56) being operable to close the delivery chamber (65) and maintain in the delivery chamber a charge of fluid stored under pressure, the selective control of the operation of the injection valve and the selective control of the fluid pressure in the low pressure chamber (37) which controls the movement of the piston means (30, 35) together providing selective control of each of the timing, the pressure and the volume of fluid injected through the injection orifice (68).

5. An injecting apparatus as claimed in claim 4 characterized in that the non-return delivery valve (56) has a movable valve member having a first stage of movement in which it moves to stop communication from the high pressure chamber (45) to the delivery chamber (65) and a second stage of movement in which the valve member after having completed its first stage of movement allows limited pressure relief in the delivery chamber (65) so as to thereby reduce the fluid pressure upstream of the injection valve (70).

6. An injecting apparatus for injecting a fluid under pressure, the injecting apparatus including:

a body (10), piston means (30, 35) movable in the body (10) under the action of externally applied fluid pressure, the piston means (30, 35) being operable to compress fluid to be injected in a high pressure chamber (45), the piston means (30, 35) being selectively movable against the action of fluid pressure in a low pressure chamber (37), the movement of the piston means (30, 35) being selectively controllable by controlling the fluid pressure in the low pressure chamber (37), a selectively controllable injection valve (70) and an associated injection orifice (68) in fluid communication with the high pressure chamber (45) whereby high pressure fluid from the high pressure chamber (45) can be injected through the injection orifice (68) upon opening of the injection valve (70), a bleed path (50, 51) for high pressure fluid to bleed from the high pressure chamber (45) upon movement of the piston means (30, 35) to a predetermined maximum extent, the opening of the bleed path (50, 51) as a result of said predetermined maximum movement occurring relieving fluid pressure in the high pressure chamber (45) to an extent sufficient to stop injection of fluid through the injection valve (70), and the selective control of the operation of the injection valve and the selective control of the fluid pressure in the low pressure chamber (37) which controls the movement of the piston means (30, 35) together providing selective control of each of the timing, the pressure and the volume of fluid injected through the injection orifice (68).

7. An injecting system comprising an injecting apparatus for injecting a fluid under pressure, the injecting apparatus including:

a body (10), piston means (30, 35) movable in the body (10) under the action of externally applied fluid pressure, the piston means (30, 35) being operable to compress fluid to be injected in a high pressure chamber (45), the piston means (30, 35) being selectively movable against the action of fluid pressure in a low pressure chamber (37), the movement of the piston means (30, 35) being selectively controllable by controlling the fluid pressure in the low pressure chamber (37), a selectively controllable injection valve (70) and an associated injection orifice (68) in fluid communication with the high pressure chamber (45) whereby high pressure fluid from the high pressure chamber (45) can be injected through the injection orifice (68) upon opening of the injection valve (70), the selective control of the operation of the injection valve and the selective control of the fluid pressure in the low pressure chamber (37) which controls the movement of the piston means (30, 35) together providing selective control of each of the timing, the pressure and the volume of fluid injected through the injection orifice (68), and the injecting system further including a fluid pressure relief path (86, 120, 121, 130) through which fluid pressure in the low pressure chamber (37) can be controllably relieved to permit and control movement of the piston means (30, 35), and an associated fluid pressure governor means (85, 90, 135, 139), the governor means being selectively controllable to control the fluid pressure in the low pressure chamber (37) by selectively preventing or progressively limiting relief of pressure from the low pressure chamber (37) through the fluid pressure relief path in response to movement of the piston means (30, 35).

8. An injecting system as claimed in claim 7 characterized in that the governor means includes a flow restriction means (135) in the fluid pressure relief path to selectively control the cross sectional area of the fluid pressure relief path, the flow restriction means (135) having an associated drive means (139) so as to drive the flow restriction means to vary the cross sectional area of the relief path, the governor means further including a back pressure valve (140) located in the fluid pressure relief path, downstream of the flow restriction means (135), the back pressure valve (140) being operative to maintain a predetermined minimum back pressure in the fluid pressure relief path by only opening when the predetermined minimum back pressure is exceeded.

9. An injecting system as claimed in claim 7 characterized in that the fluid pressure relief path (120, 121, 130) includes a pressure compensating means (122) which includes a restriction (123) and varying means (125, 126) for varying the size of the restriction (123) in response to changes in fluid pressure differentials between the restriction (123) and a point (130) downstream thereof, the varying means (125, 126) being operative to reduce the area of the restriction to maintain control of the relief of pressure through the fluid pressure relief path.

10. An injecting system as claimed in claim 9 characterized in that the pressure compensating means (122) comprises a compensating chamber (120) which communicates with the low pressure chamber (37), the pressure compensating means further including a shuttle valve (125) responsive to the pressure differential between the fluid pressure in said compensating chamber (120) and the point (130) further downstream in the fluid pressure relief path and being operative in response to an increase in the pressure differential to reduce the area of the restriction (123) and thereby retard pressure relief from the compensating chamber (120) to the point (130) further downstream.

11. An injecting system as claimed in claim 7 characterized in that the system further includes a controllable damper means (150) in communication with the fluid pressure relief path, the damper means (150) including a movable damper member (151) responsive to a pressure increase in the fluid pressure relief path to yield so as to thereby relieve pressure in the fluid pressure relief path, the damper means (150) further including an adjustable limiting means (155) associated with the movable damper member (151) to controllably limit the extent of yielding movement, the limiting means (155) thereby effectively determining the pressure relief provided by the damper means.

12. An injecting system as claimed in claim 11 characterized in that the movable damper member (151) comprises a resilient damper disc (151) which defines one wall of a chamber (152) which is in communication with the fluid pressure relief path, the limiting means (155) comprising a limiting stop which is adjustable so as to be contacted by the damper disc (151).

13. An injecting system as claimed in claim 7 characterized in that the fluid pressure relief path includes a high speed solenoid valve (105, 106) operative to open and close the fluid pressure relief path in response to actuation signals, the governor means (85, 90, 135, 139) being located downstream of the solenoid valve (105, 106) and being operative to adjustably limit in continuous increments the flow of fluid through the fluid pressure relief path.

14. An injecting apparatus for injecting a fluid under pressure, the injecting apparatus including:

a body (10), piston means (30, 35) movable in the body (10) under the action of externally applied fluid pressure, the piston means (30, 35) being operable to compress fluid to be injected in a high pressure chamber (45), the piston means (30, 35) being selectively movable against the action of fluid pressure in a low pressure chamber (37), the movement of the piston means (30, 35) being selectively controllable by controlling the fluid pressure in the low pressure chamber (37), and a selectively controllable injection valve (70) and an associated injection orifice (68) in fluid communication with the high pressure chamber (45) whereby high pressure fluid from the high pressure chamber (45) can be injected through the injection orifice (68) upon selective opening of the injection valve (70), the injection valve (70) including a valve member (70, 75) movable under the action of a fluid pressure differential between fluid pressure from the high pressure chamber (45) and against the action of fluid pressure in a control chamber (78), the fluid pressure differential being selectively controllable to control operation of the injection valve (70).

* * * * *

UNITED STATES PATENT AND TRADEMARK OFFICE

CERTIFICATE OF CORRECTION

PATENT NO. : 5,484,104
DATED : Jan. 16, 1996
INVENTOR(S) : Kukler

It is certified that error appears in the above-indentified patent and that said Letters Patent is hereby corrected as shown below:

On the title page, item [56]:

Please delete "4,948,044" and insert --4,948,049--.

Signed and Sealed this

Eleventh Day of June, 1996

*Attest:*

*Attesting Officer*

BRUCE LEHMAN

*Commissioner of Patents and Trademarks*